United States Patent [19]

Downing

[11] Patent Number: 4,612,475

[45] Date of Patent: Sep. 16, 1986

[54] INCREASED EFFICACY ARC TUBE FOR A HIGH INTENSITY DISCHARGE LAMP

[75] Inventor: Robert D. Downing, Liverpool, N.Y.

[73] Assignee: General Electric Company, Schenectady, N.Y.

[21] Appl. No.: 659,120

[22] Filed: Oct. 9, 1984

[51] Int. Cl.[4] ..... H01J 17/20

[52] U.S. Cl. ..... 313/640; 313/571

[58] Field of Search ..... 313/640, 639, 571

[56] References Cited

U.S. PATENT DOCUMENTS

Re. 27,953 3/1974 Gungle et al. ..... 313/571

3,780,342 12/1973 Grimshaw et al. ..... 315/173

3,842,307 10/1974 Dobrusskin et al. ..... 313/640 X 4,138,621 2/1979 Downing et al. ..... 313/113

*Primary Examiner*—Palmer C. DeMeo

*Assistant Examiner*—Sandra L. O'Shea

*Attorney, Agent, or Firm*—John P. McMahon; Philip L. Schlamp; Fred Jacob

[57] ABSTRACT

Disclosed is a short-arc high intensity discharge lamp having an improved arc tube as its light source. The arc tube contains an inert gas and a dosage comprising Indium (In), Mercury (Hg), Dysprosium (Dy), and Iodine (I).

7 Claims, 3 Drawing Figures

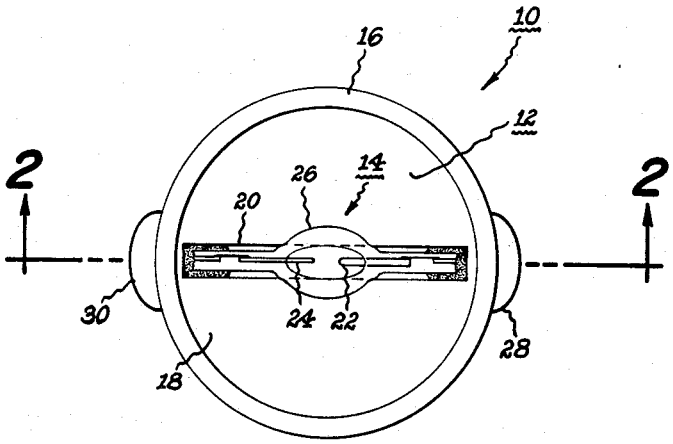
Fig. 1
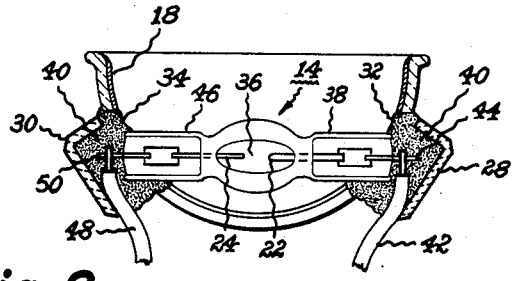
Fig. 2
Fig. 3
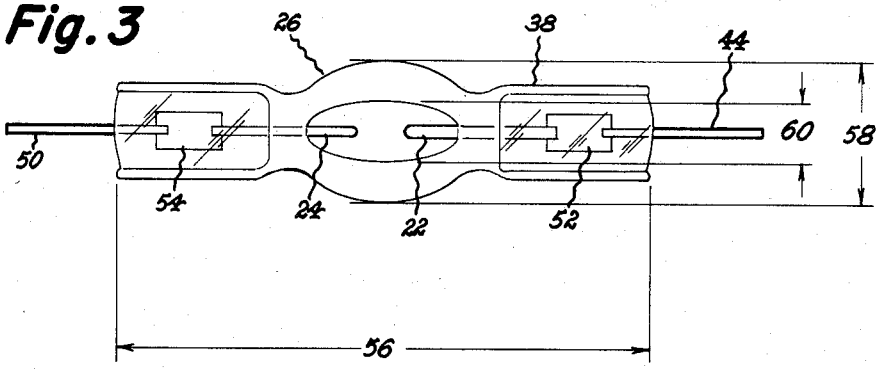

INCREASED EFFICACY ARC TUBE FOR A HIGH INTENSITY DISCHARGE LAMP

BACKGROUND OF THE INVENTION

The invention is related to short-arc high intensity discharge lamps such as used in certain photographic projectors. More particularly, the invention is related to an arc tube for short-arc high intensity discharge lamps containing a dosage that increases the lumens per watt or efficacy output and extends the anticipated life both for the arc tube.

A typical short-arc high intensity discharge lamp has an arc tube which comprises a quartz envelope having a thick-wall bulb like arc chamber, and a pair of elongated electrodes sealed into the stems of the envelope and extending from the envelope at opposite ends along a common axis. The arc chamber between the inner ends of the electrodes is about 2 to 3 millimeters, the overall bulb diameter is about 8 to 10 millimeters, and the overall length (including stems) is about 5 centimeters for a 300-watt short-arc high intensity discharge lamp.

U.S. Pat. No. 4,138,621 discloses such a short-arc discharge lamp mounted in a reflector. U.S. Pat. No. 3,780,342 to Grimshaw et al discloses a ballast circuit for the short-arc lamp, which applies a relatively high starting voltage pulse to the lamp electrodes, followed by a relatively low operating voltage.

Although the short-arc discharge lamp of U.S. Pat. No. 4,138,621 serves its desired purpose, it is desired that the efficacy, the anticipated life and total light all of the lamp be further increased. The efficacy and anticipated life are primarily determined by the arc tube of the short-arc discharge lamp.

Accordingly, objects of the present invention provide an arc tube for the short-arc high intensity discharge lamp having increased efficacy as well as increased anticipated life.

SUMMARY OF THE INVENTION

The present invention is directed to an arc tube for the short-arc high intensity discharge lamp having increased usable efficacy along with increased anticipated life. Further, the invention is directed to increasing the volume of the arc tube to increase its total light output.

The arc tube comprises an envelope having a bulb portion and a first and second elongated stems respectively extending from the bulb portion. The arc tube further comprises a first and a second elongated electrode extending into the envelope and spaced apart in the bulb portion to define an arc discharge path. The first and second electrodes are respectively sealed in first and second stems at regions thereof spaced from the bulb portion. The bulb portion contains an inert gas and a dosage comprising Mercury (Hg), Dysprosium (Dy) and Iodine (I). The bulb portion may also contain an inert gas and a doage comprising Mercury (Hg), Dysprosium (Dy), Iodine (I), and Indium (In).

BRIEF DESCRIPTION OF THE DRAWING

FIG. 1 is a front view of a lamp and reflector combination in accordance with one embodiment of the present invention.

FIG. 2 is a cross-sectional view taken along lines 2—2 of FIG. 1.

FIG. 3 illustrates the arc tube of the present invention.

BRIEF DESCRIPTION OF THE PREFERRED EMBODIMENTS

FIG. 1 illustrates a projection unit 10 comprising a reflector portion 12, preferably made of glass and molded to a circular concave shape having a light source in the form of an arc tube 14. By using a glass reflector, dimensional stability of the reflector 12 is assured. The elliptical shape of the reflector 12 concentrates the light at the far focus which conveniently may be located in front of the rim seating plane of the light unit 10 at a distance about equal to the diameter across the rim.

The reflector 12 has a rim 16 by which the lamp is supported when mounted for its typical usage in the photographic art. The reflector 12 may be coated on its inner surface with a coating 18 consisting of a known type of multiple layers interference film which is highly reflective of the visible light but transmissive of heat or infrared radiation. A metal reflector 12 with a convenient mirror finish may also be used.

The reflector 12 preferably has a cooling section 20, particularly shown in phantom in FIG. 1, located in the rear portion of reflector 12 and behind the arc tube 14. The cooling section 20 provides an additional means for cooling air, that may be developed by the photographic system, mounting the projection unit 10, to enter the reflector 12 so as to cool the arc tube 14. Further, the cooling section 20 provides the means for a portion of the ambient heat developed by the arc tube 14 to leave the general area of arc tube 14 by exiting through cooling section 20. The cooling allowed by the cooling section 20 contributes to extending the operational life of the arc tube 14.

The arc tube 14 has first and second elongated electrodes 22 and 24 extending into the arc tube 14 and spaced apart in a bulb portion 26 of the arc tube 14 to define an arc discharge path. The electrodes 22 and 24 are preferably formed of tungsten wire. The illustrated lamp 10 is intended for (D.C.) direct-current operation. The anode 22 is formed of a tungsten wire having a larger diameter than the electrode 24. For D.C. operation the electrode 22 serves as the anode of the arc tube 14 whereas the electrode 24 serves as the cathode of the arc tube 14. For an alternating-current (A.C.) operation, the two electrodes 22 and 24, are substantially of the same size. The lamp 10 operates with electrodes 22 and 24 close to the melting point of tungsten and may operate with substantially molten tips resulting in rounding and balling of the electrode ends during operation. The electrical connection of the electrodes 22 and 24 along with the mounting of arc tube 14 between shoulders 28 and 30 are all shown in detail in FIG. 2.

The reflector 12 has apertures 32 and 34, respectively, which are centered on a line passing through the near focus 36 of the reflector 12 and transverse to the optical axis of the lamp 10.

Arc tube 14 is mounted laterally on the reflector's optical axis with its stem 38 projecting into aperture 32. The stem 38 is set in a glassy cement 40 which fills the volume of the aperture 32. An insulated wire 42 is welded to an inlead 44 and enters into shoulder 28 through a small side aperture at the rear of shoulder 28. The other stem 46 of arc tube 14 projects into aperture 34 and is set in the glassy cement 40 which fills the volume of the aperture 34. An insulated wire 48 is welded to an inlead 50 of the arc tube 14 and enters into shoulder 30 through a small aperture at the rear of shoulder 30.

During the assembly of lamp 10, before cement 42 sets hard, arc tube 14 is optically aligned relative to the rim 16 of the unit 10. Preferably, a cement is used which sets quickly under heat and bonds to both the glass reflector 12 and the arc tube 14 typically formed of a quartz material. One suitable cement comprises a primarily fine alumina and calcined kaolin along with minor additives of disodium phosphate and trialuminum phosphate mixed with phosphoric acid to form a paste.

By setting the stems 38 and 46 of the arc tube 14 in cement 42 so that it is rigidly fixed to reflector 12, a projection lamp unit 10 results wherein the arc tube is accurately located in the optical reference system. When subsequently the unit 10 is inserted into a suitable socket and its rim 16 properly accommodated, both by the photographic system mounting the unit 10, unit 10 provides the desired light without further adjustment.

The arc tube 14 may have a starting aid device which may be of the type described in the previously mentioned U.S. Pat. No. 4,138,621 to which reference may be made for further details with regard to its description related to starting aid device 36.

In operation, for the arc tube 14 to initiate its initial arc discharge condition, a relatively high starting voltage of about 8,000 volts to about 10,000 volts generated by a ballast circuit, is applied across the anode and cathode of the arc tube 14. After its initial arc condition, a voltage in the range of about 40–120 volts generated by a current-limiting ballast circuit, maintains the arc tube in its operating condition.

In accordance with the present invention, the arc tube 14, shown in a slightly enlarged manner in FIG. 3, serves as the light source for lamp 10. The arc tube 14 comprises a quartz envelope having a generally elliptical central portion or bulb 26 provided with the generally cylindrical outwardly extending stems or extensions 38 and 46 having outer diameter considerably less than that of the bulb 26. The first and second electrodes 22 and 24 are welded to molybdenum foils 64 and 66, respectively, the foils 52 and 54, in turn, being respectively welded to inleads 44 and 50. The foils 52 and 54 are wetted by the quartz materials of the stems 38 and 46, respectively, to provide hermetic seals for the arc tube 14.

The arc tube 14 as has a typical overall length 56 of about 4.2 cm and the outer diameter 58 at the central region of its bulb portion 26 is typically of about 12 millimeters. The internal diameter 60 at the central region of the bulb 26 is about 6 millimeters. The arc length between the inner ends of electrodes 22 and 24 is about 4 millimeters.

The arc tube 14 has increased efficacy and increased anticipated life both as compared to prior arc tubes for short-arc high intensity projection discharge lamps. The arc tube 14 contains an inert gas such as argon having a typical fill pressure of about 300 torr. The improvements to the arc tube 14 is primarily achieved by a dosage comprising Mercury (Hg), Dysprosium (Dy) and Iodine (I). The dosage may also comprise Mercury (Hg), Dysprosium (Dy), Iodine (I), and Indium (In).

The dosage contained in the arc tube 14 may in a first embodiment comprises:

Hg of 27.12 micromoles (89.4 mole %);

Dy of 0.44 micromoles (1.4 mole %);

$I_2$ of 2.78 micromoles (9.2 mole %); and an additive of In in the range of 0 to about 0.73 micromoles.

A second embodiment may have the given ingredients of the first embodiment with the following ranges:

Hg of about 7 micromoles to about 243 micromoles;

Dy of about 0.1 micromoles to about 2.0 micromoles;

In of about 0.2 micromoles to about 6.5 micromoles; and $I_2$ of about 0.7 micromoles to about 25.0 micromoles.

For the second embodiment having the given ranges, the volume of the arc tube 14 is in the range of about 0.1 cubic centimeters to about 0.5 cubic centimeters. For such volumes, the spacing between the first and second electrodes is in the range of about 2 mm to about 6 mm.

The operation of the short-arc high intensity discharge lamp 10 having the hereinbefore disclosed arc-tube provides a pressure-broadened spectrum in the wavelengths of 430 to 700 nanometers. The arc tube 14 has about a 40% increase in efficacy compared to prior arc tubes not having the benefits of the present invention.

The arc tube 14 of the present invention was subjected to testing in excess of 250 hours without experiencing a failure and exhibited an initial increase of efficacy of 40% as compared to prior arc tubes.

It should now be appreciated that the short-arc high intensity discharge lamp 10 of the present invention provides for increased efficacy and increased anticipated life as compared to the prior art devices.

Further, it should be appreciated that although as previously discussed, the cooling section 20 provides for additional cooling of the arc tube 14, the wall temperature of the arc tube may be further decreased by a volume increase of the arc tube chamber. The decrease improves the anticipated life of the arc tube.

It should also be appreciated that, although the short-arc high intensity discharge lamp 10 has been described as having reflector 12 with an elliptical shape, the practice of this invention contemplates reflectors having various type concave shapes such as parabolic or spherical. For such reflectors it is important that the arc tube 14 be arranged within the reflector so as to accommodate the optical consideration of the short-arc high intensity lamp.

Further, although the arc tube 14 has been described for a short-arc high intensity discharge lamp, it is contemplated that the teaching of this invention is applicable to other types of applications where a similarly specified high intensity discharge arc tube may be utilized, e.g. stage, studio and fiber optics.

Still further, the arc tube 14 may be used in other lighting applications requiring bright efficient sources.

What I claim as new and desire to secure by Letters Patent of the United States is:

1. An arc tube for a high intensity discharge lamp comprising:

an envelope having a bulb portion and first and second elongated stems respectively extending from said bulb portion;

first and second elongated electrodes extending into said envelope and spaced apart in said bulb portion to define an arc discharge path, said first and second electrodes respectively sealed in said first and second stems and regions thereof spaced from said bulb portion, and;

a filling containing an inert gas and a dosage comprising Mercury (Hg), Dysprosium, (Dy), Iodine (I)

and Indium (In), wherein the given ingredients of said filling are in the range of:

Hg of about 7 micromoles to about 243 micromoles;

Dy of about 0.1 micromoles to about 2 micromoles;

In of about 0.2 micromoles to about 6.5 micromoles; and $I_2$ of about 0.7 micromoles to about 25.0 micromoles.

2. An arc tube according to claim 1 wherein said dosage comprises:

Hg of 27.12 micromoles (89.4 mole %);

Dy of 0.44 micromoles (1.4 mole %);

$I_2$ of 2.78 micromole (9.2 mole %); and an additive of In in the range of 0 to about 0.73 micromoles.

3. An arc tube according to claim 1 wherein the volume of said arc tube is in the range of about 0.1 cubic centimeters to about 0.5 cubic centimeters and the spacing between the first and second electrodes is in the range of about 2 mm to about 6 mm.

4. An arc tube according to claim 1 wherein said envelope has an overall length of about 4.2 cm, an outer diameter of about 12 mm, an inner diameter of about 6 mm, and the spacing between the first and second electrodes is about 4 mm.

5. An arc tube as claimed in claim 1, in combination with the concave reflector, said stems of said arc tube lying on a common axis, said arc tube being mounted in said reflector along an axis transverse to the optical axis of the reflector.

6. A high intensity discharge lamp according to claim 5 wherein said reflector further comprises a cooling section cut out of the rear portion of said reflector and located behind said mounted arc tube.

7. A high intensity discharge lamp according to claim 5 further comprising a starting aid arranged about said arc tube.

* * * * *